United States Patent [19]

Linkletter et al.

[11] Patent Number: 5,067,254

[45] Date of Patent: Nov. 26, 1991

[54] METHOD AND APPARATUS FOR MODIFYING A VEIL OF MATERIALS IN A DRUM OF A DRYING APPARATUS

[75] Inventors: Don R. Linkletter, Cedar Rapids; Joseph E. Musil, Ely, both of Iowa

[73] Assignee: Cedarapids, Inc., Cedar Rapids, Iowa

[21] Appl. No.: 529,136

[22] Filed: May 25, 1990

[51] Int. Cl.[5] ..... F26B 11/02

[52] U.S. Cl. ..... 34/137; 34/135; 432/112; 432/111; 432/105

[58] Field of Search ..... 34/137, 135; 432/105, 432/107, 108, 110, 111, 112, 113, 114, 118; 366/24, 25

[56] References Cited

U.S. PATENT DOCUMENTS

| | | | |
|---|---|---|---|
| 719,717 | 2/1903 | Arbuckle . | |
| 1,238,394 | 8/1917 | Eldred . | |
| 3,054,193 | 9/1962 | Wright | 34/137 |
| 3,395,905 | 8/1968 | Isheim et al. | 34/137 |
| 3,871,829 | 3/1975 | Keith et al. | 34/137 |
| 3,943,637 | 3/1976 | Hanser | 34/137 |
| 4,071,962 | 2/1978 | Saeman | 34/135 |
| 4,427,376 | 1/1984 | Etnyre et al. | 432/105 |
| 4,693,015 | 9/1987 | Hemsath et al. | 34/41 |
| 4,892,411 | 1/1990 | Elliott et al. | 34/137 |

*Primary Examiner*—Henry A. Bennett
*Assistant Examiner*—Denise L. F. Gromada
*Attorney, Agent, or Firm*—Simmons, Perrine, Albright & Ellwood

[57] ABSTRACT

An improvement to a drum drying and mixing apparatus includes a baffle plate arrangement is supported externally of the drum adjacent one end thereof and is inserted longitudinally from that one end into the drum. Baffle plates of the arrangement are disposed in the veil of materials in a drying section of the apparatus. Pivoting the baffle plates about an axis substantially transverse to the direction of the falling material in the veil modifies the veil to create a channel substantially void of material through at least portions of the veil. Hot drying gases moving longitudinally through the veil encounter a reduced resistance to the flow in the channel and divert from movement through the falling materials in the veil to move through the channel within the region of the veil. As a result the heat transfer from the drying gases to the aggregate materials is reduced and the final temperature of the hot drying gases exiting from the drum increases. The arrangement may be used to control the temperature of the drying gases exiting from the drum and advancing to a baghouse filter.

22 Claims, 2 Drawing Sheets

METHOD AND APPARATUS FOR MODIFYING A VEIL OF MATERIALS IN A DRUM OF A DRYING APPARATUS

BACKGROUND OF THE INVENTION

1. Field of the Invention

The invention relates generally to methods of and apparatus for drying and heating materials in a stream of hot gases. More particularly the invention relates to methods and apparatus for controlling a material drying and heating process independently of an adjustment of the hot gas generator.

2. Discussion of the Prior Art

Asphalt production facilities typically use drum drying and mixing apparatus for heating aggregate materials and for mixing the materials with liquid asphalt. The drying and heating process of the materials is effected by a flow of heated gases through the length of the drum. Drum drying and drum drying and mixing apparatus is typically characterized as either parallel flow or as counterflow apparatus. In the counterflow apparatus, the direction of flow of the gases is opposite the general flow of the material through the drum. In the parallel flow the gases and material exit at the same end of the drum. In both types of apparatus, a cylindrical drum of substantial size is disposed with its axis in a substantially horizontal position. A slight incline from one end to the other of the longitudinal axis places the end of the drum at which materials are fed into the drum at a slightly higher elevation than the opposite, material discharge end of the drum.

The drum is supported on a frame on trunnion rollers to rotate about its longitudinal axis. Flights are attached to the inner surface of the drum to lift the material as a result of the rotational movement of the drum, and to release the material gradually across an upper arc of the rotational movement of the drum, creating a curtain or veil of falling material within the inner space of the drum. The rate of axial advance of the material within the drum is of course affected by the angle of incline of the axis of the drum and the type of flights within the drum.

The hot gases exiting from the drum contain a substantial amount of water vapor as a result of the drying operation. The exhausting gases further contain fine dust which became entrained in the gas flow. When the operation involves a downstream mixing operation, the gases would typically contain also hydrocarbons in vapor form. The hydrocarbons as vapor are typically undesirable pollutants in that they would condense to form fine droplets of pollution carried by the gas stream when the gases are exhausted directly into the atmosphere.

In compliance with environmental standards, the dust and other pollutants are sought to be removed from the stream of hot drying gases before the gases are returned to the environmental atmosphere. Various types of filters and scrubbing methods are known and have been tried. A popular filtering process involves a filter which is known as a baghouse filter. A baghouse filter is a chamber in which a great number of filter bags are suspended. The hot gases are introduced into the chamber externally of the bags. The bags have upper openings which are coupled to exit ports from which the hot gases can exit to the environment. The gases consequently pass from the outside of the bags through the walls of the bags into the bags and from there to the environment. Particulate material in solid and liquid form is consequently deposited on the outside of the bags as the hot gases exit through the bags from the chamber. As the material deposits and cakes on the surface of the bags, the gas flow through the bags becomes more and more restricted. Baghouse filters consequently include provisions for applying reverse flow pressure to the bags to remove the deposits from the bags. Thus from time to time, all or a selective number of the bags may be "puffed" with air pressure applied to the inside of the bags to cause the caked deposits to drop off from the outside of bags and fall to the base of the chamber. A chute or conveyor in the base of the chamber typically removes the fines deposits from the base of the chamber.

Problems have occurred with respect to cleaning baghouse filters when the temperature of the hot exhaust gases drops below a level at which water vapor begins to condensate. Condensation is likely to occur first across the interface of the bags, possibly because the filtering process is also accompanied by a slight pressure drop across the interface. Such a pressure drop might even increase, as the filter becomes more clogged. Typically, the temperature of the exhaust gases would be measured at the exit chamber from the drum, though the temperature of the gases may decrease further in ducting routing the gases to the filter chamber. For typical installations it has been observed that when the temperature of the exhaust gases drop below a temperature of 250 degrees Fahrenheit, with some variation depending of course on the amount of moisture contained in the exhaust, the material being deposited on the filter walls will tend to become sludgy. The sludge remains pliable and adheres strongly to the walls of the filter bags. As a result, the reverse pressure application to the bags often fails to clear the caked material and renders the baghouse frequently inoperative and ready for extensive downtime.

Problems can also occur when the exhaust temperature exceeds a certain desirable range above the referred to minimum temperature of 250 degrees Fahrenheit. These problems relate to pollution control and possible damage to the filters. Excessive temperatures clearly can damage the filter bags. But also, in order to meet clean air standards, it is desirable to maintain the exhaust temperatures as low as possible above the condensation temperature of water vapor, to allow hydrocarbons to condense and be collected by the fine dust carried by the gases to the filter. Ideal exhaust temperatures would allow any and all hydrocarbons to be condensed and collected by the aggregate fines at the filter walls with substantially no water vapor condensation. It is consequently desirable to control the exhaust temperature of the drum drier apparatus to remain within a narrow range of about 250 degrees Fahrenheit.

The drying process may be regulated by controlling the burner unit, many typical burner units providing a ten-to-one turndown ratio to adjust the burner output to the rate of material flow through the drum such that the material has a desired dryness and temperature at the end of the drying and heating section of the drum. Certain material flow patterns through the drum in the past have caused problems in that a correct dryness and temperature of the aggregate at the end of the drying and heating section of the drum has resulted in an exhaust gas temperature which falls below the desired temperature range for routing the exhaust gases to the baghouse filter. Increasing the burner capacity, however, would have tended to result in an aggregate temperature which may be higher than desired. Additions of recycle material to virging aggregate material add further complexity. Any change in material mixes in various proportions between recycle and virgin aggregate material, and changes in the moisture contents and porosity of the virgin material to be dried are major factors that may cause wide variations in exhaust gas temperatures by affecting heat transfer between the burner-generated hot gases and the aggregate. A change in the mix of virgin material to recycle material typically calls for a change in the final temperature of the virgin material. In many state of the art operations, the heat stored in the virgin material is typically used to dry and heat the recycle material. Thus, at one extreme, with no recycle material to be dried, virgin material would be dried and heated to substantially the desired temperature of the final asphalt mix. At the other extreme, however, with a one-to-one mix ratio of virgin and recycle material, the temperature of the virgin material may be heated well above the desired temperatures of the final mix, in that the heat stored in the virgin material is transferred to the recycle material in an indirect drying and heating operation. In seeking to arrive at the proper asphalt mix temperature, changes in the exhaust gas temperatures continue to present problems.

Consequently, controlling the exhaust gas temperature independently of a burner adjustment continues to be a problem a solution to which would be desirable.

SUMMARY OF THE INVENTION

It is an object of the invention to control the exhaust gas temperature by altering the heat exchange efficiency between hot gases in a dryer-mixer drum and aggregate materials being dried and heated in such drum.

It is another object of the invention to provide a continuous process of controlling the flow pattern of hot gases with respect to aggregate materials in an aggregate drying and heating process to change the amount of exposure of the aggregate materials to the hot gases.

It is a further object of the invention to provide apparatus for controlling the temperature of exhaust gases exiting from a dryer-mixer in route to a filter house without altering the energy input to the dryer-mixer.

It is yet another object of the invention to provide an apparatus for altering the flow pattern of hot gases in a drier drum or dryer-mixer drum.

It is another and more particular object of the invention to provide to control the temperature of the exhaust gases in response to changes which are causes by changes in the mix ratio of recycle material to virgin aggregate material.

According to one aspect of the invention, an improvement relates to a process of drying and heating materials in a rotating drum. During the process to which the improvement pertains the materials are elevated by the rotation of the drum. The elevated materials are then scattered from an inner surface of the drum in an evenly dispersed veil of falling material over an upper arc of the rotational path to traverse downward through the inner space of the drum. Hot gases flow in the axial direction through the inner space of the drum, such that the veil of falling material traverses the flow of hot gases. The improvement pertains to deflecting the veil of falling material to create a tunnel extending through the veil of falling material the tunnel being void of the falling material. The hot gases are then routed through the tunnel void of falling material, the change in the pattern of the ga flow limiting the transfer of heat to the material, thereby raising the temperature of the hot gases exiting from the drum.

According to a particular aspect of the invention the veil is deflected to a greater extent with respect to an initial position in response to a change in a ratio of recycle material to virgin material fed into drum, in which the ratio is decreased.

An apparatus according to the invention includes a gate disposed in the axial direction of the drum through the length of the drum occupied by a veil of material during the operation of the apparatus. The gate is mounted for rotational movement about an axis substantially parallel to the axis of the drum pivot about that axis and become interposed as a shield of varying area in the veil of falling material. A pivotal position at an angle to the falling material forms bounds a space void of falling material through the veil, forming a tunnel for the hot gases to move without contacting the material.

BRIEF DESCRIPTION OF THE DRAWINGS

The Detailed Description of the Invention will be best understood when read in reference to the accompanying drawings wherein.

DETAILED DESCRIPTION OF THE INVENTION

Figure 1:
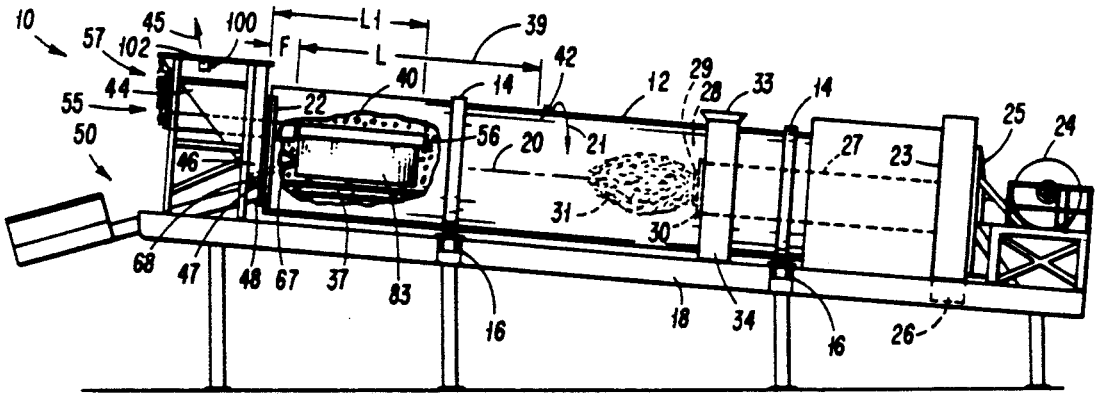
FIG. 1 is a somewhat schematic and simplified side elevational view of a drying and mixing drum apparatus, showing an overall view of a flow modification gate as a specific embodiment of the present invention.

Referring now to FIG. 1, there is shown a drum type drier-mixer apparatus designated generally by the numeral 10. Such drier-mixer apparatue may particularly be a drier-mixer apparatus used in the production of asphaltic materials, as may be used for paving roadways and other hard-surfaced areas. A characteristic element of the apparatus 10 is a drum 12 of cylindrical shape and circular cross section. Steel tires, such as the set of two tires 14 shown in FIG. 1 extend circumferentially about the exterior of the drum 12 at spaced apart locations of the drum. The tires 14 rest on trunnions 16 which in turn are mounted to a support frame 18. The trunnions 16 consequently support the drum for rotational movement with respect to the support frame 18 about a central axis 20. The apparatus 10 is shown in FIG. 1 as being in a preferred operating position, in which the drum 12 is disposed with its axis of rotation 20 at a small angle with respect to the horizontal. In general, the orientation of the drum gives the appearance of being substantially horizontal, though the small incline, typically in a range of five degrees, has the effect of allowing gravity to interact with the rotation of the drum 12 in advancing aggregate material through the drum 12. An arrow 21 denotes a typical direction of rotation of the drum 12. At a typical angle of incline a feed end 22 of the drum 12 is raised above an opposite discharge end 23 of the drum 12.

The apparatus 10 depicted in FIG. 1 is a counterflow type drier-mixer apparatus. Though the invention is described with respect to a counterflow apparatus, it is conceivable to modify a parallel flow type drier-mixer in accordance herewith to obtain advantages of the invention. As a counterflow drier-mixer, the apparatus 10 has a blower motor 24 and an external burner support structure 25 disposed adjacent a material discharge chute 26 at the discharge end 23 of the drum 12. The particular apparatus 10, as described herein has a tube 27 extending concentrically with the drum 12 from the discharge end into the drum 12. The tube 27 is a support structure which terminates in a central portion 28 of the drum 12 to support a burner unit and nozzle 29 at its inner end 30. The displacement of the burner nozzle 29 to the central portion 28 of the drum 12 effectively divides the drum into an upper drying section and a lower mixing section. The tube 27 of an advantageous prior art embodiment comprises dual concentric tubes and fuel supply pipes, not shown. The outer tube 27, is not only the support for the burner nozzle 29 but also provides secondary air, while the concentrically disposed inner tube supplies primary air to the burner nozzle 29 within the drum 12. The inwardly displaced burner nozzle 29 in combination with the secondary air tube 27 isolates the lower mixing region of the drum 12 not only from direct exposure the heat of the flame of the burner, but also from the hot gases and from the flow of air in general, thereby providing a more ideal chamber for mixing asphaltic materials.

As is typical in drying and mixing drums, two or more different types of flights are mounted to the inner surface of the drum 12. A flame region 31 exists immediately upstream of the burner nozzle 29. In certain aggregate mixing operations, in which virgin aggregate is mixed with recycled asphaltic pavement, the recycled material is preferably shielded from exposure from the flame of the burner, from the hot gases generated by the burner and preferably from excessive amounts of oxygen once the recycled material is heated by being mixed with heated virgin aggregate material. According to known practices, the drum 12 has a secondary feed port 33 and a feed collar 34 about the drum 12. Recycle materials are introduced through the feed port 33 and collar 34 into the drum 12 downstream of the burner nozzle 29, hence downstream of its flame.

The flame region 31 of the drum 12 features typical heat shield flights which, in accordance with known practices, lift aggregate material and drop the lifted material along both vertical sides of the drum 12, but very little, if any, from a position directly overhead. Consequently, the flights avoid releasing the material to fall directly through the plume of the flame. The heat shield flights consequently protect the flame of the burner from being extinguished by the falling material and position more material along the side positions of the drum 12, thereby shielding the side positions from intense heat of the flame. The material in this flame region of the drum is heated primarily by radiation.

Located upstream of the flame region of the drum 12 are typical lifting flights or basket flights 37. The basket flights 37 are used throughout a major drying region 39 of the drum 12. The basket flights 37 differ in both configuration and function from the heat shield flights. The basket flights 37 lift the material substantially across an upper arc of the rotational path of the drum 12, evenly scattering or releasing the material. The material consequently falls from the upper walls evenly distributed throughout the inner space of the drum 12 to generate an evenly distributed veil 40 of falling material across the entire interior section of the drum 12. The section in which the basket flights 37 are disposed in essence functions as a drying chamber for the aggregate materials. Different structures of basket flights are known and used, but the particular structure of the basket flights 37 is not of concern to the invention, since all of the various basket or lifting flights are to implement a function of generating the veil of material within the drum 12. The hot gases generated by the burner flame advance through the drying region 39 of the drum 12 toward the feed end 22 of the drum 12, thus against the direction of general movement of aggregate material. The veil has a thickness or length "L" in the axial direction of the drum 12 which terminates at the downstream end at a transition 42 between the major drying region 39 and the flame 31 region of the drum 12. Typically, an upper or upstream end of the axial length of the veil 40 is begins with a first set of basket flights 37 next to a feed-in transitional region "F" adjacent the feed end 22 of the drum 12. If the flights 37 may have a length of five feet, for example, four rows of such flights in the axial length of the drum 12 giving the region 39 an overall length of 20 feet within the drum. The density of material in the veil 40 may be varied by the number and arrangement of the flights 37. Thus, first and second rows of the flights 37, as counted from the feed end 22 of the drum, may contain sixteen flights, while a subsequent row of flights closer to the burner nozzle 29 may only contain eight of the flights 37. A final row of basket flights 37 adjacent the heat shield flights may only contain four flights, consequently limiting the amount of material in the veil. The region "F" (see FIG. 1) is typically populated with skewed flights 43, which because of their angular mounting along the drum 12 push material toward the downstream end of the drum, and which are typically and appropriately known as intake flights.

At the feed end 22 of the drum 12 the hot gases are routed from the drum into an exhaust box or chamber 44 and advance from there typically upward and to a filter, such as a typical baghouse filter (not shown), the direction of the exhausting of the gases being indicated by an arrow 45. In a lower portion 46 of the exhaust chamber 44, an opening 47 admits a front end 48 of a typical slinger type feed conveyor 50. A slinger type feed conveyor feeds aggregate material at a typical linear feed rate of, for example, four hundred feet per minute. Such a rate is considered to be a high rate of feed which "slings" the material into the interior of the drum 12. Any back-scattered material is moved by the intake flights 43 downstream of the drum toward the first row of the basket flights 37 within the major drying region 39.

A modification of the previously described apparatus 10 allows the temperature of the exhaust gases entering the exhaust chamber 44 to be controlled as further described herein. In reference to FIG. 1, attached to the outside of the exhaust chamber 44 at the feed end 22 and extending from there into the drum 12 is a veil modification assembly or baffle assembly 55. Because of the rotation of the drum with respect to external support structures, an inner end 56 of the baffle assembly extends as a cantilever into the drum 12. The corresponding outer end, a baffle control assembly 57 is attached at the top of a mounting plate 58 of the control assembly 57 to a support frame 59 of the exhaust chamber 44 and to the sloping surface of the exhaust chamber 44 itself. From the lower end of the mounting plate 58, a main support angle 62 extends inward into the drum 12 in parallel to and preferably above the longitudinal axis 20 of the drum 12.

Figure 2:
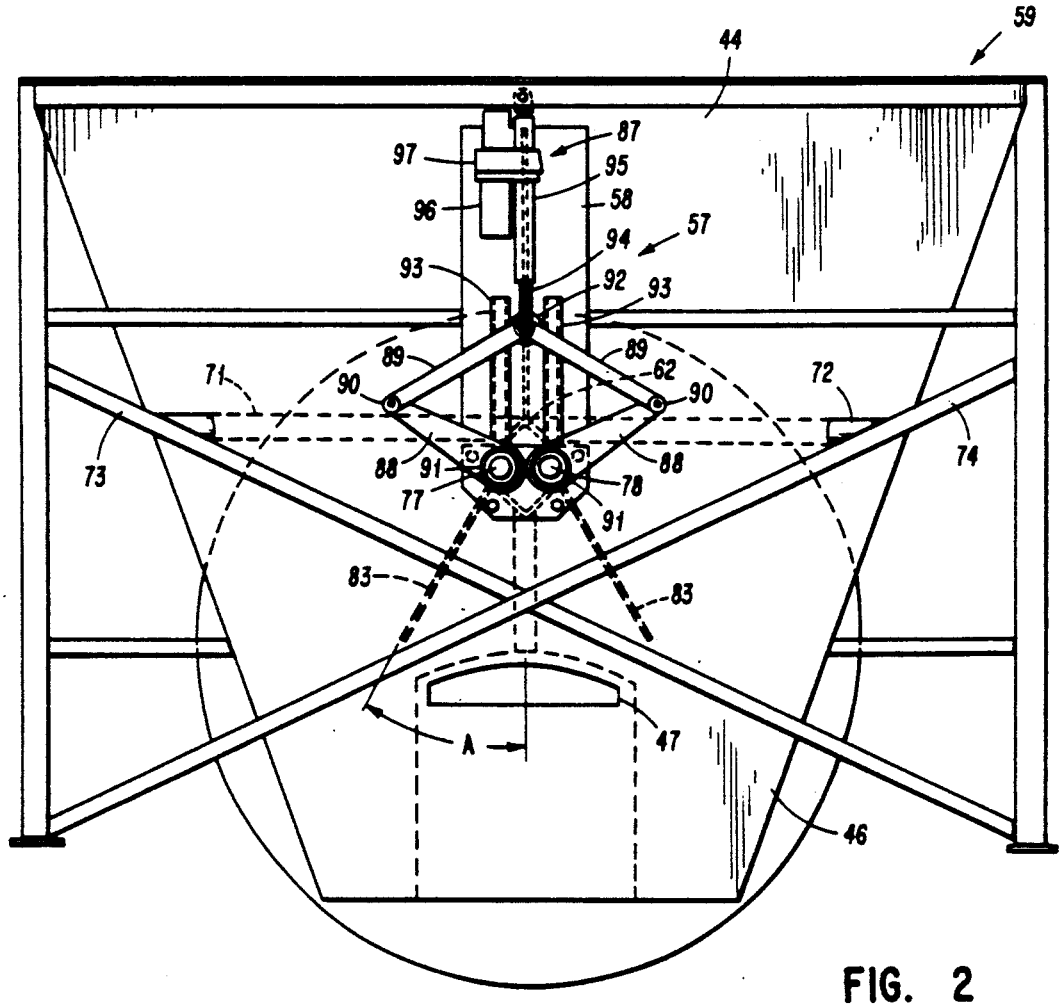
FIG. 2 is an end view of the apparatus shown in FIG. 1, the view taken from the feed end of a drum of the apparatus, showing in greater detail some of the elements of the flow or veil modification gate or apparatus, including a preferred actuating mechanism.
Figure 3:
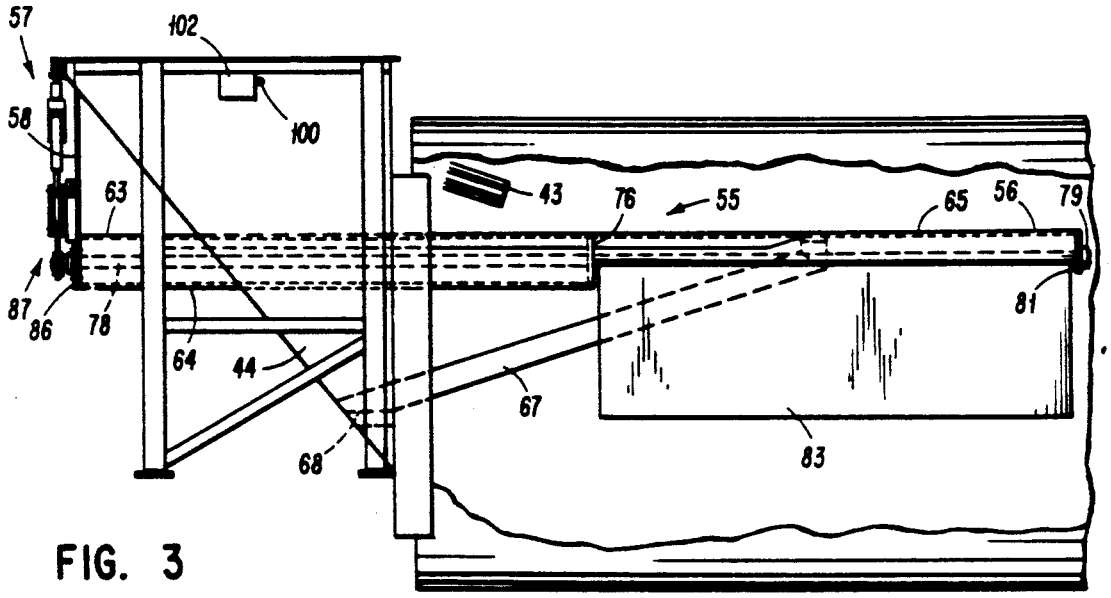
FIG. 3 is an side view of the veil modification apparatus, showing baffle plates and details of a support structure therefor.

In reference to FIG. 2, the main support angle 62 is welded at its outer end to the mounting plate 58 in a roof type orientation with the two leg sections of such angle sloping downward, symmetrically from its apex. FIG. 3 best illustrates various details attached to and carried by the main support angle 62. An outer support length 63 of the angle 62 is reinforced by a second angle iron of identical section, a lower support angle 64, which is inverted with respect to the main angle 62 and abutted and welded its flanges to the corresponding flanges of the main angle 62, forming a tube of square cross section. An inner length 65 of the main support angle 62 and, hence of the baffle assembly 55, is desirably supported intermediate its ends by a tubular support brace 67. The support brace 67 extends downward in the vertical plane of the axis 20, and at a downward slope out of the feed end 22 of the drum and through the wall of the exhaust chamber 44 to be attached to a lower cross beam 68 of the support frame 59, as shown in FIG. 1. Lateral support for the inward extending baffle assembly 55 may be provided similarly by left and right tubular members 71 and 72. The tubular members 71 and 72 extend from the main support angle 62 toward the feed end 22 of the drum 12 in a plane orthogonal to the plane defined by the support brace 67 with the axis 20. Extending away from the main support angle 62, the tubular members 71 and 72 also extend through the wall of the exhaust chamber 44 to be attached to cross braces 73 and 74 of the support frame 59.

Referring to FIGS. 2 and 3, a center support gusset 76 of substantially square shape is welded to both the angle 62 and the inner end of the lower support angle 64. The gusset 76 in essence closes off the inner end of the tube formed by the joined angles 62 and 64. The gusset provides two bearing apertures which are disposed in line with left and right baffle shafts 77 and 78, as shown in FIG. 2. In referring particularly to FIG. 3, the baffle shafts 77 and 78 extend from the baffle control assembly 57 into the drum 12 and are secured at the innermost end of the baffle assembly 55 by a retainer bearing plate 79. The bearing plate 79 is abutted and fastened to an end plate 81 of the main support angle 62. Each of the baffle shafts 77 and 78 support at their inner length, corresponding in essence to the inner length of the baffle assembly 55, a respective baffle plate 83. The baffle plates 83 are rigidly attached to their respective shafts 77 and 78. Consequently, any rotation of the shafts about their longitudinal axes results in a corresponding angular, pivotal reorientation of the respective plates 83 about pivot axes coinciding with the axes of the shafts 77 and 78. In a deactivated state, the baffle plates 83 hang vertically downward from their respective shafts 77 and 78, as shown for example in FIG. 3. Outer ends 84 of the shafts 77 and 78 extend through respective left and right hand bearing apertures of an outer support bearing plate 86. The outer support bearing plate 86 is attached to the lower end of the mounting plate 58. The axial length of the baffle plates 83 is subject to some discretion, keeping in mind that the baffle assembly 55 as a whole needs to be supported within the drum by a support structure which is fixedly supported outside of the drum 12. The length of the baffle plates 83 may be chosen to extend entirely through the veil 40, though that is not deemed necessary.

The outer ends 84 of the shafts 77 and 78 are attached to the baffle control assembly 57. In reference to FIG. 2, an actuating mechanism for operating the baffle plates 83 is designated generally by the numeral 87. The mechanism 87 may be regarded as a dual-acting slider crank mechanism. The mechanism 87 includes left and right baffle crank arms 88 and left and right slider crank levers 89. As may be seen in FIG. 2, the respective left and right crank arms 88 and slider crank levers 89 are symmetrically operated to impart the same angular displacement to both baffle plates 83. In a preferred embodiment, each of the slider crank levers 89 is a pair of flat links. The links may be joined intermediate their ends, but for simplicity, a pair of spacedly superimposed links constitute functionally one of the slider crank levers 89. The links straddle a pivot joint 90 at each of the outer ends of the crank levers 88. The links of the slider crank arms 89, consequently extend spacedly in parallel with each other. Such dual link structure allows the driving force to be transmitted centered on the pivot joints 90, exerting a balanced force along a centerline between each pair of parallel links which forms a respective one of the crank levers 89. An alternate embodiment, not shown, would comprise a single lever and forked pivot joints to be symmetrically pinned to the left and right crank arms 88, for example.

The plates 83 move from the straight downward position through a range indicated by the angle designation "A", the left baffle plate 83 deflecting upward to the left through the same angle as the right baffle plate 83 deflects upward toward the right. The baffle crank arms 88 may be attached to the ends 84 in any of a number of known ways for rotationally locking a crank to a shaft to transmit torque. Keys or setting bolts or screws may be used or the ends 84 of the shafts 77 and 78 may have splines and hubs 91 on the corresponding ends of the crank arms 88 may be fluted correspondingly.

Upper ends of the slider crank levers 89 are pivotally linked to each other at a pivot shaft of a slider bearing 92. The slider bearing 92 is restrained for unidirectional, vertical movement by a track consisting of two vertically disposed, laterally spaced guide members 93. A lower end of a linear drive link 94 is pinned to the slider bearing and straddled by the upper ends of the links of the slider crank lever 89. The drive link 94 is consequently constrained to linear movement defined by the guide members 93. A linear actuator 95 for driving the linear drive link 94 may be any of a number of typical linear locking actuators. For example, a worm type rack and pinion drive is considered one of the manners in which a vertical linear driver is implemented. Another manner may be by a lockable hydraulic positioning cylinder. Typically, a motor 96 may drive through a worm drive reduction drive 97 to linearly advance or retract the drive link 94.

Figure 4:
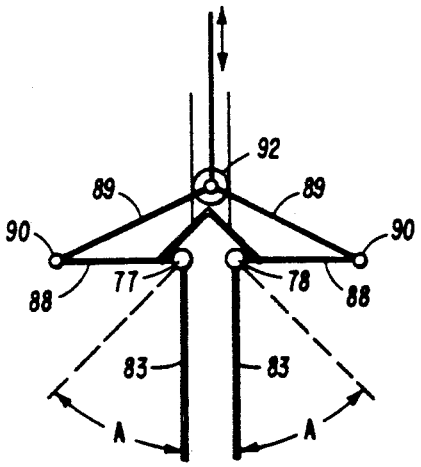
FIG. 4 is a schematic end view of the veil modification apparatus, to illustrate particular advantages of the operation of the apparatus.

The operation of the baffle assembly 55 or veil modification assembly is best explained with respect to FIGS. 1 and 4. The length of the baffle assembly 55 is such to extend into the drum 12 to a depth "L1". The inner end 56, consequently, is disposed well within the veil region as identified in FIG. 1 by "L". Since typical basket flight arrangements provide for a veil 40 of greater density adjacent the feed end 22 of the drum, the baffle plates 83 are preferably operable in the region in which the greatest density of material would be maintained. Alternate embodiments of the baffle assembly 55 are possible, such as by changing the length of the baffle plates 83 to extend to a lesser or greater degree into, or even entirely through the drying section in which the veil is generated. In a de-active position the baffle plates 83 depend straight downward from beneath the main support angle 62. The veil 40 is in such state of the baffle plates 83 substantially unaffected by the assembly 55. In fact, a space between the adjacent baffle plates 83 is longitudinally blocked by the support brace 67.

If the temperature of the hot gases in the exhaust chamber are determined to approach a minimum value, below which, for example humidity in the hot exhaust gases would tend to condense, the baffle assembly 55 may be operated to spread the baffle plates 83 apart with respect to each other to assume a new position within the range indicated by the angle "A" in FIG. 4. Spreading or pivoting the baffle plates 83 along their pivot axes, namely along the shafts 77 and 78, changes the projected area of the baffle plates 83 with respect to the direction of movement of the falling materials in the veil 40. In a position in which the baffle 83 are in parallel with respect to each other, the projected area of the baffle plates 83 with respect to the direction of the falling materials in the veil 40 is at a minimum, being substantially of the width of the main support angle 62. As the baffle plates 83 are pivotally moved, the projected area of the plates 83 becomes increasingly larger with respect to the falling material in the veil 40. As the projected area increases, the baffle plates 83 become exposed to, and deflect, more and more material from its normal path in the veil. Thus, the baffle plates 83 become gradually increasingly interposed into the stream of falling materials to increasingly modify the uniformity of the veil. Of course, the reverse is also correct; the effect of the baffle plates 83 of modifying the veil becomes less as the plates are pivoted toward each other.

The described pivotal movement of the baffle plates 83 is considered to be or particular significance in apparatus, such as the described apparatus 10 which is capable of drying heating and mixing aggregates including recycle materials. For various reasons, including specifications and availability, the ratio of the amount of recycle material in the final asphalt material mix may vary. And it is often necessary to switch from one mixing ratio to another. It has been experienced, that the exhaust temperatures tend to vary widely when the mix ratio of recycle material to virgin aggregate material is changed. Virgin aggregate material is typically quarry rock, while recycle material is recycled asphaltic pavement which is removed from existing road beds to be used again as an aggregate in the asphaltic material to resurface a road bed from which it may have been scraped. Typically, as disclosed with respect to the apparatus 10, the recycle material is introduced downstream of the flame region 31 and is heated to a desired temperature of the mix by heat transfer from the virgin aggregate material which has preferably been heated to a temperature higher than that of the final mix.

When the production of asphaltic material needs to be shifted from a one-to-one mixing ratio of recycle material to virgin aggregate material to a composition consisting solely of virgin material, the energy transfer efficiency in the drum 12 changes significantly. The feed rate of the virgin material is suddenly increased to twice that of it was before, while the feed rate of the recycle material is stopped. The amount of material in the veil correspondingly increases. As a result more heat is transferred from the hot gases in the veil 40 and the temperature of the hot gases exhausted drops. As a corollary the energy in the material is increased, such that the desired temperature of the product would also increase. Pivoting the baffle plates 83 as described has the effect of reducing the rate of heat transfer from the hot gases to the aggregate material to substantially the level prior to the change to all virgin aggregate, thus restoring in a simple and efficient manner the status quo of the flow process.

It is readily seen that as a general proposition, even in the absence of a reference to the exhaust temperature of the hot gases, a change in the ratio of the recycle material to virgin material from an initial ratio, such as one-to-one, to a ratio which is less than the initial ratio, the position of the baffle plates 83 would need to be changed to open the passage between the plates 83 and permit a greater proportion of the hot gases to escape from the path through the veil 40 without significant contact with the material in the veil. On the other hand, if the second ratio becomes greater than the first ratio, hence more recycle material and less virgin aggregate material is used to make up the mix, the baffle plates 83 would need to be adjusted toward each other to reduce the space of the passage and force more of the hot gases through the remaining material in the veil 40. Though the adjustment of the baffle plates could conceivably be effected manually and without reference to a monitored temperature, continuously monitoring the temperature of the hot gases being exhausted is preferred.

Sensing or monitoring the exhaust temperature may conveniently be accomplished by a temperature probe 100, which may be mounted in the exhaust chamber 44. Temperature probes, such as the probe 100 are well known in the art. The probe 100 may be a bi-metallic transducer generating an analog voltage signal. The magnitude of the sensed voltage is typically applied to a control circuit, such as indicated in FIG. 1 by the numeral 102. Control circuits, such as the control circuit 102 are well known in the art. Typically such control circuits 102 are used for generating error signals in response to a comparison test of a measured parameter. Because transmission of control circuits require only typical electrical control wires, the location of the control circuit 102 is not critical. It may be preferred to locate the control circuit 102 adjacent the motor 96 as part of the baffle control assembly 57. In reference to operating a control circuit such as the control circuit 102, typically the parameter is read as an electrical input signal and compared to a reference signal which is established within the control circuit 102. A control signal may be generated in response to such electrical comparison, which control signal may activate a power circuit such as a power circuit 103 coupled to an actuator, such as the motor 96 to energize the motor and pivot the baffle plates 83 to, for example, open the space between the two baffle plates.

The effect of opening the space between the two baffle plates 83 is twofold. First of all, the baffle plates modify the uniformity of the veil 40 by becoming interposed between the downward falling material in the veil. The material impinges on the baffle plates and is deflected outward into the outer veil, increasing the density of the remaining veil, and toward the inner surface of the drum 12 with a lesser exposure to the hot gases. Secondly, prior to opening the space between the two baffle plates 83, the hot gases had moved through the veil 40 and encountered the impedance to the flow presented by the mass of the falling materials within the veil. When the baffle plates 83 are spread by any significant distance, the hot gases find a path of lesser impedance in the space beneath the baffle plates 83. Such space is sheltered from falling material. Hence, a void of falling material exists in the "shadow" of, or behind, the projected area of the baffle plates 83, as viewed from the direction of the falling materials in the veil 40. The void in the falling materials, of course, constitutes a passage of lesser resistance for the hot gases to traverse the veil. A greater volume of the gases exit, consequently, through the tunnel-like passage or channel 101 formed by the spread between the baffle plates 83 beneath the veil 40, and correspondingly less of the hot gases take the winding path past the material in the veil. As a result of the veil modification generated by the outward spreading of the baffle plates 83, the heat transfer from the gases to the material is reduced and the temperature of the exhaust gases exiting the drum 12 through the exhaust chamber 44 is raised. As the orientation of the baffle plates 83 is gradually changed, the cross section of the tunnel or channel 101 changes to gradually and continually modify the veil and change the flow pattern of the hot gases as a result thereof.

One parameter of the drying cycle, however, remains without recognizable change. That parameter is the time period during which the material remains in the drying region of the drum 12. Thus, as the veil is modified, the gas flow and heat exchange is altered, yet the time for the material to traverse the drying region remains the same. This may be of significance when a drying cycle is established for material which has a certain porosity and capacity to hold moisture. It may consequently take a predetermined time period to allow the water to evaporate before the heating of the aggregate stones of the materials takes place. By altering the thermal efficiency of drying section, the heating of the aggregate at the end of the drying cycle may be affected without cutting short the time period for allowing water to evaporate.

It is contemplated to use the described invention of modifying the veil 40 in an automated mode with a feedback control, in which the temperature monitored by the temperature probe 100 is coupled to a feedback control system 101, such as may be associated with the actuator motor 96. The control may also be effected remotely from a personnel operated system control center (not shown). In a feedback control operation, a desired exhaust temperature would have been established as a predetermined reference temperature. The temperature of the exhaust gases measured, for example, in the exhaust chamber would be compared to the reference temperature. It is important to establish a normal position of the baffle plates 83, which is other than the fully downward position. In the fully downward position of the baffle plates 83, an adjustment in only one direction would be possible. On the other hand, a slight initial spreading of the baffle plates 83 may have a significant initial effect on the gas flow without even much modification of the veil, in that suddenly a bypass is offered to the hot gases and the overall pressure drop of the gases may change. A preferred operating range of the baffle plates is from the vertical to approximately a 45 degree position. In such an overall operating range, an initial reference position of ten degrees, for example, or a setting in a range close to such position setting may be chosen. The thermal output of the burner nozzle 29 may then be appropriately adjusted to obtain the reference temperature of the exhaust gases in the exhaust chamber 44. In response to a deviation of the temperature from the reference temperature, an error signal would correspondingly energize the motor 96 to reduce or increase the cross-sectional area of the tunnel or channel 101 beneath the baffle plates 83. In a manual mode, a deviation from a desired temperature would be noted and by an operator, and an adjustment of the position of the baffle plates 83 to modify the veil 40 would be initiated. When the reference temperature established is the minimum temperature of the gases that will be permitted to exit, the baffle plates 83 may initially be in their lowermost position, in that only a spreading of the baffle plates 83 would be effected by an error correction.

Figure 5:
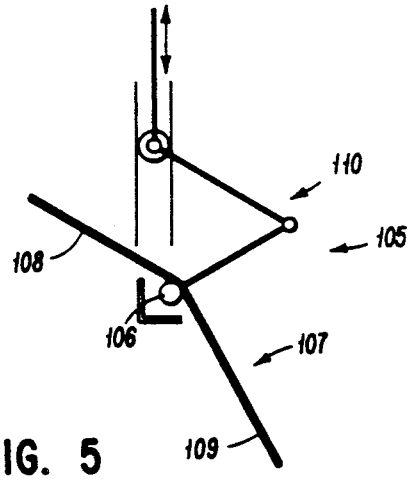
FIG. 5 is a schematically simplified representation of an alternate embodiment of the invention.

FIG. 5 depicts an alternate embodiment of the veil modification, according to which a baffle assembly 105 employs only a single shaft 106 and, correspondingly, only a single baffle plate 107. In implementing such alternate embodiment, consideration may be given to balancing forces in operating the baffle plate 107, in that there would not exist interfering movement with a second plate in operating the single baffle plate 107. It is therefore possible to extend the baffle plate by some distance above the shaft 106. Thus, when the single plate 107 is rotated to modify the veil 40, impacting material an upper portion 108 of the plate 107 would result in a moment about the shaft 106 which would counteract and partially offset the moment generated by the weight and impacting material on a lower, depending portion 109 of the baffle plate 107.

In an embodiment of a single baffle plate, it may be desirable to bend the upper portion 108 with respect to the lower portion 109, as indicated in FIG. 5. The bend shown into the rotational rising side of the drum 12, would have the effect of blending in with a lateral component of movement of the material in the veil 40 adjacent the top arc of the drum 12, the lateral component resulting from the material being discharged substantially parallel to the direction of peripheral motion of the drum 12. Rotation of the single baffle plate 106 could be effected by an actuator mechanism 110 which in essence would be a single implementation of the mechanism 87. Thus, a corresponding single crank arm 88 fastened in the described manner to the end of the shaft 106 would be moved by a corresponding slider crank lever 89, actuated by the motor 96 and the linear drive link 94.

Figure 6:
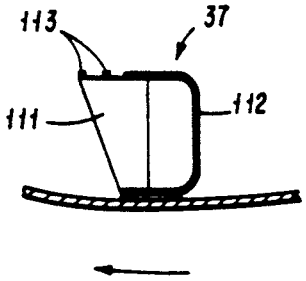
FIG. 6 PRIOR ART
FIG. 6 is a pictorial representation of a typical, prior art basket flight, such as may be used in the drying and mixing apparatus for generating a veil of material which may be modified by the invention as further described herein with respect to the drawings.

FIG. 6 shows a typical structure of the basket or lifting flights 37, though various shapes thereof are known and used with success. Side plates 111 transverse to the longitudinal axis 20 of the drum support a scoop-like end portion 112 and innermost spaced bars 113, which are characteristic and have caused the lifting flights to be referred to as basket flights.

As already indicated with respect to some implementations of a preferred embodiment of the invention, various changes and modifications in the structure of the described embodiment are possible without departing from the spirit and scope of the invention.

What is claimed is:

1. A method of drying aggregate material which comprises:

scattering the material from an upper wall of an elongate chamber over a predetermined length of the chamber to generate a veil of substantially evenly distributed falling material in an interior space of the chamber and extending in thickness over substantially the predetermined length of the chamber;

flowing hot drying gases longitudinally of the chamber through the chamber, the hot gases traversing the veil of falling materials for transferring heat energy from the hot gases to the falling materials to dry and heat the materials;

forming within the length of the veil a channel substantially void of falling material longitudinally of and within the chamber, causing at least some of the hot gases to bypass the veil of falling materials; and gradually varying the cross-sectional area of the channel to vary the extend to which the hot gases bypass the materials in the veil of falling materials, such bypassing hot gases retaining heat energy for controlling the temperature of gases exhausting from the chamber.

2. A method according to claim 1, wherein the chamber is a substantially horizontally disposed drum of a drum drying and mixing apparatus, said drum rotating about a longitudinal axis, and the veil is generated by a plurality of lifting flights disposed on an inner surface of a drying region in such drum, and wherein the step of gradually varying the cross-sectional area of the channel comprises:

pivoting at least one baffle plate extending at least partially through the veil about a longitudinally extending axis and thereby changing a projected area of the plate interposed into the stream of falling materials in the veil.

3. A method according to claim 2, wherein pivoting at least one baffle plate comprises pivoting a pair of baffle plates simultaneously through equal and opposite angles of deflection from a de-activated angle in which the pair of baffle plates extend substantially parallel to each other and to the direction of falling material in veil.

4. A method according to claim 2, wherein the method is a method of drying and mixing aggregate material including virgin material and recycle material in a selected ratio, wherein the virgin material passes through and exits from said chamber, wherein the recycle material is mixed with the virgin material subsequent to the virgin material exiting from said chamber, and wherein the selected ratio is subject to change, the step of pivoting comprising pivoting said at least one baffle plate to increase the projected area of the plate with respect to the veil of material in response to a change in the ratio of said recycle material to said virgin aggregate material proportionally decreasing the recycle material, and pivoting said at least one baffle plate to decrease the projected area of the plate with respect to the veil of material in response to a change in said ratio increasing proportionally the recycle material.

5. A method according to claim 2, further comprising measuring the temperature of hot gases exiting from the drum, and comparing the temperature to a predetermined minimum reference temperature the method comprising pivoting the baffle plate to increase the projected area of the baffle plate in the direction of the falling material of the veil.

6. A method according to claim 5, wherein pivoting at least one baffle plate comprises pivoting a pair of baffle plates simultaneously through equal and opposite angles of deflection from a de-activated angle in which the pair of baffle plates extend substantially parallel to each other and to the direction of falling material in veil.

7. Apparatus for modifying a veil of falling materials, the veil of materials being generated in a drying and heating region of a substantially horizontally disposed elongate drum of a drying and mixing apparatus, within which drum the drying and heating is effected by a stream of hot gases flowing longitudinally of the drum and traversing the length of the veil of falling materials, the apparatus for modifying the veil comprising:

at least one baffle plate supported within the drying and heating region of said drum and extending at least partially through the veil of falling materials; and means for supporting the at least one baffle plate for pivotal movement about an axis disposed substantially parallel to the longitudinal axis of the drum, to change the projected area of the baffle plate with respect to the direction of the falling materials in the veil, whereby a pivotal movement of the at least one baffle plate creates a void of material in the veil below said baffle plate.

8. Apparatus according to claim 7, wherein the veil has a predetermined length in the axial direction of the drum and has further a greater density of material at a first end region of the veil with respect to the density at a second, opposite end region of the veil, and wherein the baffle plate is disposed to be operable within at least such first end region of the veil.

9. Apparatus according to claim 7, wherein the at least one baffle plate comprises a pair of baffle plates disposed adjacent and in parallel with each other, and wherein said means for supporting at least one baffle plate for pivotal movement is a means for supporting said pair of baffle plates for pivotal movement.

10. Apparatus according to claim 9, wherein said means for supporting said pair of baffle plates for pivotal movement comprises:

support frame fixedly supported externally and independently the drum;

a mounting plate disposed externally of the drum and attached to the support frame;

a main support extending from said mounting plate into said drum, said main support being attached to and supported by said support frame;

a pair of shafts extending substantially in parallel with the longitudinal axis of the drum and in parallel with the main support into said drum, each of said shafts supporting one of said baffle plates along an inner end portion within the drum; and means for supporting said shafts with respect to said main support.

11. Apparatus according to claim 10, and further comprising:

means for pivotally moving each of the baffle plates simultaneously with and through an equal and opposite arc as the other.

12. Apparatus according to claim 11, wherein the means for pivotally moving each of the baffle plates is a dual-acting slider crank mechanism.

13. Apparatus according to claim 12, wherein the dual-acting slider crank mechanism comprises:

a pair of crank arms, each crank arm rigidly attached at a first end to an outer end of a respective one of the shafts, the crank arms extending from said first ends of attachment to the respective shafts away from each other;

a pair of slider crank levers, a first end of each of the slider crank levers being pivotally mounted to a second, outer end of a respective one of the crank arms, the second ends of the slider crank levers having a pivot point and being pivotally joined to each other at said pivot joint;

a linear actuator link having a lower end guided for linear movement, said lower end of the actuator link being pivotally coupled to said pivot joint at said second ends of said slider crank levers; and means for linearly activating said actuator link.

14. Apparatus for modifying a veil of falling materials, the veil of materials being generated in a drying and heating region of a substantially horizontally disposed elongate drum of a drying and mixing apparatus, said drying and mixing apparatus comprising means for generating a stream of hot gases to move longitudinally through said drum and through said veil of falling materials for drying and heating said materials and exit from said drum after having transferred heat energy to said materials, the veil modifying apparatus comprising:

means, extending at least partially through the veil of falling materials, for deflecting materials from their path in the veil upon impingement of such materials with a projected area of said deflecting means, and for generating a channel void of said falling materials behind said projected area of the deflecting means to enable the hot gases traversing the veil of falling materials to flow through said channel without contacting such falling materials; and means for altering the size of said projected area of said deflecting means to change a cross-sectional area of said channel, thereby correspondingly altering the quantity of hot gases which flow through said channel, whereby heat conduction from said hot gases to said materials becomes altered as a result of the altered flow of such gases through said channel.

15. Apparatus according to claim 14, wherein the materials deflecting means is at least one plate being pivotally mounted within the drum and extending at least partially longitudinally through the veil of falling materials, and wherein means for altering the size of the projected area of the plate comprises means for pivoting said at least one plate about an axis transversely to the direction of the falling materials in the veil.

16. Apparatus according to claim 15, further comprising means for determining the temperature of the hot gases exiting from said drum, means for comparing the temperature relative to a desired temperature of said gases exiting from said drum, and means for increasing said projected area of said plate upon determination that the temperature of the hot gases has fallen below said desired temperature.

17. Apparatus according to claim 16, further comprising means for determining the temperature of the hot gases exiting from said drum, means for comparing the temperature relative to a desired temperature of said gases exiting from said drum, and means for increasing said projected area to raise the temperature of the gases exiting from the drum and for decreasing said projected area to lower the temperature of the gases exiting from the drum.

18. Apparatus according to claim 17, wherein the movement of the materials in the veil longitudinally through the drum is opposite to that of the flow of hot gases through drum and the apparatus further comprises means, mounted externally and independently of said drum adjacent a material feed end of said drum and extending from said feed end of the drum into said drum, for pivotally supporting said at least one plate.

19. In a drum drying and mixing apparatus for asphaltic materials, including a substantially horizontally disposed cylindrical drum having first and second ends, being supported for rotation about a substantially horizontal, longitudinal axis, and having a drying region with means for generating a veil of falling material in response to material passing through such drying region, means for feeding a first aggregate material into said first end of said drum to pass through said drying region in a direction downstream toward said second end, means for generating a flow of hot gases within and through the drying region of said drum longitudinally of the drum to traverse said veil of falling material and to exit thereafter from said drum, means for introducing a second aggregate material into the drum downstream of said drying region, wherein the improvement comprises:

means disposed within the drying region for deflecting material in said veil of falling material and for generating a passage through at least a portion of veil of falling material; and means for gradually altering the effectiveness of said deflecting means to increase the effectiveness of said deflecting means in response to an increase of material flow through said drying region and to decrease the effectiveness of said deflecting means in response to a decrease of material flow through said drying region.

20. The improvement according to claim 19, wherein said deflecting means is at least one pivotally mounted baffle plate having a pivot axis extending substantially parallel to the axis of the drum, and wherein said means for gradually altering the effectiveness of said at least one baffle plate comprises means for gradually pivoting said at least one baffle plate to increase the projected area with respect to the direction of the falling material in response to an increase of material flow through said drying region and to decrease the projected area with respect to the direction of the falling material in response to a decrease of flow of material through said drying region.

21. An improvement according to claim 20, wherein said first aggregate material is virgin aggregate material and said second aggregate material is recycle material and wherein said increase and decrease in material flow through said drying region is the result of a change in the ratio of recycle material to virgin aggregate material.

22. An improvement according to claim 21, wherein said at least one plate is a pair of baffle plates having pivot axes disposed adjacent and parallel to each other.

* * * * *

UNITED STATES PATENT AND TRADEMARK OFFICE

CERTIFICATE OF CORRECTION

PATENT NO. : 5,067,254

DATED : November 26, 1991

INVENTOR(S) : Linkletter et al.

It is certified that error appears in the above-identified patent and that said Letters Patent is hereby corrected as shown below:

Column 4, Line 4, "in the pattern of the ga flow limiting the transfer of heat" should read --in the pattern of the gas flow limiting the transfer of heat--. In the claims, Column 13, Claim 4, Line 52, after "in a selected ratio," should be inserted --wherein the virgin material is subjected to the step of scattering,--. In the claims, Column 15, Claim 13, Line 15, delete "point" and insert therefor --joint--.

Signed and Sealed this

Twentieth Day of April, 1993

*Attest:*

*Attesting Officer*

MICHAEL K. KIRK

*Acting Commissioner of Patents and Trademarks*